United States Patent [19]

Nacenta Atmella

[11] Patent Number: 4,917,075

[45] Date of Patent: Apr. 17, 1990

[54] ARRANGEMENT FOR COOKING BY GAS COMBUSTION

[75] Inventor: José M. Nacenta Atmella, Barcelona, Spain

[73] Assignee: Catalana De Gas, S.A., Barcelona, Spain

[21] Appl. No.: 332,732

[22] Filed: Apr. 4, 1989

[30] Foreign Application Priority Data

Apr. 12, 1988 [ES] Spain ..... 8801114

[51] Int. Cl.[4] ..... F24B 9/00

[52] U.S. Cl. ..... 126/33; 126/377; 126/369.3; 126/20; 126/21 A

[58] Field of Search ..... 126/376–378, 126/369–369.3, 20, 348, 21 A, 5, 33

[56] References Cited

U.S. PATENT DOCUMENTS

| | | | |
|---|---|---|---|
| 277,833 | 5/1883 | Cook | 126/377 |
| 337,303 | 3/1886 | Burkhard | 126/33 |
| 730,748 | 6/1903 | Dickson | 126/33 |
| 1,060,458 | 4/1913 | Kelly | 126/20 |
| 1,144,954 | 6/1915 | Waters | 126/20 |
| 1,595,188 | 8/1926 | Hadaway | 126/20 |
| 3,199,223 | 8/1965 | Carlson | 34/77 |
| 4,660,542 | 4/1987 | Schere | 126/369 |

*Primary Examiner*—Carroll B. Dority
*Attorney, Agent, or Firm*—Staas & Halsey

[57] ABSTRACT

An arrangement for cooking by combustion of gas in which a thermal fluid flows between a boiler, in which it is heated, and heaters where it releases the heat received, the thermal fluid returning to the boiler. The heaters are provided with a cavity limited at the top by a plate generally flush with the hob of the arrangement. The thermal fluid is preferably vaporized in the boiler and is condensed in the heaters. The arrangement facilitates cleanliness of the hob and provides for correct exhaustion of the combustion gases.

6 Claims, 2 Drawing Sheets

ARRANGEMENT FOR COOKING BY GAS COMBUSTION

BACKGROUND OF THE INVENTION

1. Field of the Invention

The invention relates to an arrangement for cooking by gas combustion, including a hob in which there is at least one heater.

2. Description of the Prior Art

The cooking arrangements (frequently called cookers), based on gas combustion, are usually provided with rings located on the hob of the cooker. Said rings are supplied with gas when the corresponding control is operated and when the gas is ignited. They provide a flame which is obviously useful for cooking.

Nevertheless, these known arrangements suffer from certain drawbacks. One of these is the presence of the flames on the hob, since such presence may lead to an undesirable fire. Furthermore, the gases originated from the combustion tend to disperse, which makes good channelling and exhaustion by a chimney difficult, frequently requiring the use of extractor fans and troublesome hoods.

Furthermore, each ring represents a member projecting above the hob itself and therefore makes cleaning of the cooker difficult, since the projecting portion forms corners and like places where spills or other remains may easily collect. It should also be pointed out that a grid is frequently needed to support the cooking utensils, this being a further element requiring cleaning, which is not easy either.

SUMMARY OF THE INVENTION

An object of the invention is to overcome the above drawbacks. To such end, the invention provides an arrangement of the type mentioned at the beginning characterised in that each heater is formed by a cavity limited at the top thereof with a plate generally flush with the hob, said cavity being provided with at least one access means and in that it includes: a boiler containing a burner where said gas combustion may take place, as well as a first heat exchanger adapted to receive the heat produced by said combustion, said first heat exchanger being provided with an outlet port and a return port; an outgoing and return communication circuit between said first heat exchanger and each said heater, the circuit including a distribution network communicating said outlet port with each said cavity and a return network communicating each said cavity with said return port; a thermal fluid within said heat exchanger and which is capable of flowing through whole or part of said distribution network, which is capable of reaching one or more of said heaters and which is capable of flowing through said return network back to said heat exchanger; and a plurality of valves for controlling the access of the thermal fluid to said heaters.

BRIEF DESCRIPTION OF THE DRAWINGS

Further advantages and features of the invention will be disclosed in the following description wherein, without any limitative nature, there is disclosed a preferred embodiment of the invention, with reference to the accompanying drawings, in which.

DESCRIPTION OF THE PREFERRED EMBODIMENTS

Figure 1:
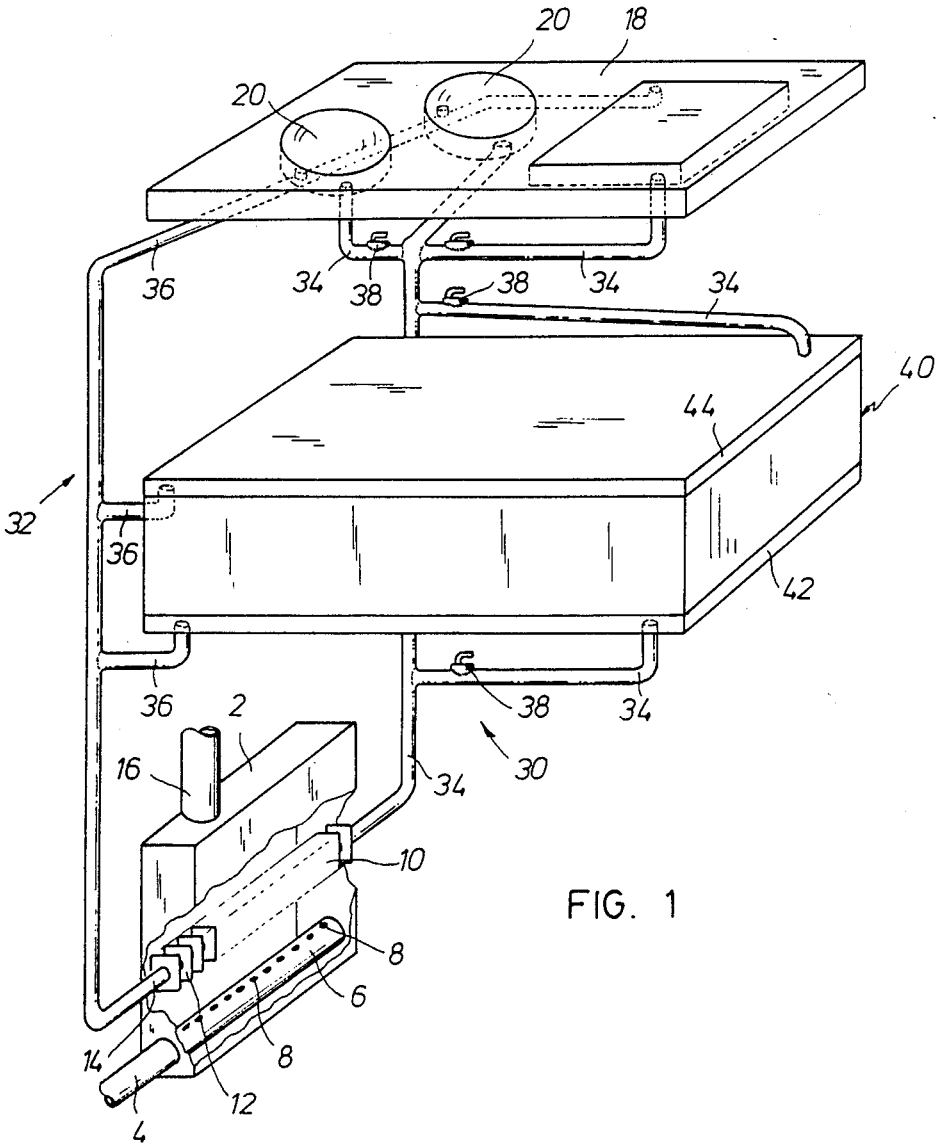
FIG. 1 is a schematic perspective view of the cooking arrangement of the invention, from which the framework members have been omitted.

The cooking arrangement of the present invention is based on the combustion of a gas reaching a boiler 2 through a conduit 4. Within the boiler 2 the conduit is connected to a burner 6, provided with orifices 8 through which the gas may flow, forming a flame. The burner 6 may be of any known type and therefore may be in the linear form schematically shown, or may adopt any other appropriate form.

Also in a convenient position within the boiler for receiving a maximum amount of the heat produced by the gas combustion there is a first heat exchanger 10, preferably including a plurality of plates 12 or like members adapted to be heated and traversed by a conduit 14. The heat exchanger 10, relative to the boiler, is provided with an outlet port and a return port. The boiler 2 is provided with a smokestack 16 which has also been illustrated schematically and cutaway; said smokestack is obviously adapted to provide an adequate exhaustion of the gases resulting from the combustion.

Figure 3:
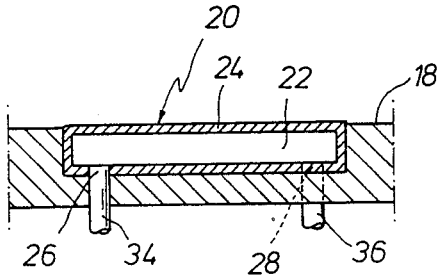
FIG. 3 is a schematic section view of a heater situated in the corresponding hob.

Furthermore, the cooking arrangement includes a hob 18, that is, a body having a generally flat horizontal surface on the top thereof. In said hob there are one or more heaters 20, each of which is formed by a cavity 22 (FIG. 3) limited at the top thereof by a plate 24 generally flush with the hob. The cavity is provided with at least one means of access to the interior thereof, which means may be formed by an inlet orifice 26 and an outlet orifice 28. Nevertheless, there is also contemplated the existence of a single aperture (not shown) which will be referred to again hereinafter.

Each heater 20 is mounted in the hob 18 in such a way that there is a minimum of corners or other like places in which dirt-forming elements may lodge. This arrangement facilitates cleaning of the cooking arrangement of the invention which, together with the flush fitting, avoids the formation of hard-to-get-at corners which would hinder the cleaning operations.

The arrangement also includes a circuit providing out-going and return communication between the first heat exchanger 10 and each of the heaters 20. The circuit is provided with a distribution network 30 placing the outlet port of the heat exchanger 10 in communication with each of the cavities 22 of the heaters 20. There is also a return network 32 placing each cavity 22 in communication with the return port of the heat exchanger 10.

The distribution network 30 is formed by a plurality of conduits 34 forming branches for correct access to each of said cavities 22. Where the cavity 22 is provided with the inlet orifice 26, the conduits 34 are connected at the end thereof with said orifices 26.

In turn, the return network 32 is formed by a second plurality of conduits 36 which may extend from the outlet orifice 28 and connect finally to the conduit 14 of the heat exchanger.

The arrangement includes a thermal fluid within the first heat exchanger 10 and which is heated by the burner 6. In this case, the fluid is adapted to flow through whole or part of the distribution network 30, the access of the thermal fluid to the heaters 20 being controlled by valves 38.

As an example of the thermal fluid to be used, there is cited a mixture of diphenyl (26.5%) and diphenyl oxide (73.5%) marketed by Bayer AG under the name of Diphyl; by Dow Chemical under the name of Dowtherm A and by Monsanto and British Petroleum as VP1. A further example is a mixture of isomeric benzyltoluenes marketed by Hüls under the name of Marlotherm L.

When the thermal fluid is supplied to certain heaters 20, selected by way of valves 38, it releases its heat in the corresponding cavity 22, whereby it is suitable for directly or indirectly heating the food it is desired to cook.

Said fluid then flows through the return network 32 until it reaches the heat exchanger 10 again and the cycle is resumed. The valves 38 regulate either the access of the gas to the heater or the outlet of the condensate, this latter alternative being preferred.

The thermal fluid is preferably vaporized during its passage through the heat exchanger and flows through the distribution network 30 in vapor form. On reaching a cavity 22 of a heater 20, the thermal fluid is condensed, which augments the transfer of heat in the heater 20. The passage of fluid through the return network 32 is effected in liquid state, the cycle being likewise resumed in the heat exchanger.

The said change of state allows a cavity 22 to be provided with a single aperture or access means, through which the fluid enters in the vapor phase and exits through the same orifice in the liquid phase, being collected in a branch of the conduit connected to the single aperture.

Figure 4:
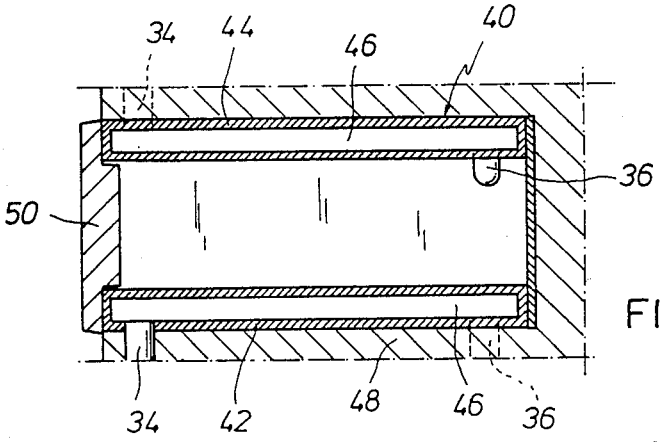
FIG. 4 is schematic section view of an oven including two heaters.

It is also contemplated that the arrangement may be provided with ovens. A first oven 40 is illustrated very schematically in FIG. 1 and in section in FIg. 4. The oven 40 is provided with a lower wall 42 and an upper wall 44 and each wall 42, 44 is formed analogously to the heaters 20. I.e., they include a cavity 46 into which the thermal fluid flows and is condensed, giving up heat. Like the remaining heaters, the walls 42, 44 are connected to conduits 34 of the distribution network 30 and with conduits 36 of the return network 32. In accordance with conventional techniques, the ovens 40 are provided with thermal insulation means 48 and a door 50. The upper wall 44 is adapted to operate as a gratinating plate and the lower wall 42 as a hotplate.

Figure 2:
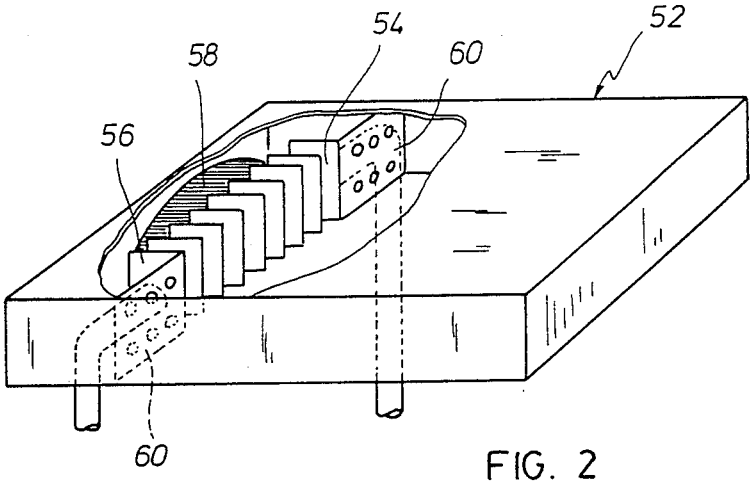
FIG. 2 is a schematic perspective view of a forced convection oven.

Another oven 52 operates as a forced convection oven. The oven 52 (FIG. 2) is provided with a second heat exchanger 54 forming part of the arrangement circuit, whereby the thermal fluid may flow therethrough. It is furthermore provided with a large heat-exchanging surface 56, preferably formed by a series of plates. Impeller means 58, such as a fan or like member, produces an air current which flows adjacent the heat-exchanging surface 56, whereby it absorbs heat therefrom and said hot air current is directed to the interior of the oven 52, providing the necessary heat. Lateral plates 60 establish a return current, so as to reinitiate the flow of air through the second heat exchanger 54.

What I claim is:

1. An arrangement for cooking food in a food cooking container by gas combustion, comprising:

a hob in which there is at least one heater, each heater being formed by a cavity limited at the top thereof with a plate generally flush with the hob, said plate receiving directly said food cooking container thereon, and said cavity being provided with at least one access means a boiler containing a burner where said gas combustion takes place, as well as a first heat exchanger adapted to receive the heat produced by said combustion, said first heat exchanger being provided with an outlet port and a return port;

an outgoing and return communication circuit between said first heat exchanger and said at least one access means of each said heater, the circuit including a distribution network communicating said outlet port with each said cavity and a return network communicating each said cavity with said return port;

a thermal fluid within said heat exchanger and which is capable of flowing through whole or part of said distribution network, which is capable of reaching one or more of said heaters and which is capable of flowing through said return network back to said heat exchanger, wherein the plate is in contact with the thermal fluid; and a plurality of valves which control the access of the fluid to the at least one heater.

2. The arrangement of claim 1, wherein when said burner is ignited, the thermal fluid within said heat exchanger is vaporized and, on arriving at said heaters, said thermal fluid is condensed.

3. The arrangement of claim 1, further comprising an oven provided with a lower wall and an upper wall, each of which is formed by a heater including a cavity in fluid communication with said distribution network and with said return network, wherein food is cooked between the lower and upper walls, and wherein the temperature of the lower and upper walls can be separately regulated via the plurality of valves.

4. The arrangement of claim 1, further comprising an oven which is associated with a second heat exchanger forming part of said circuit, through which said thermal fluid flows and which is provided with a large heat-exchanging surface, there being impeller means adapted to produce a current of air flowing adjacent said heat-exchanging surface and into the interior of said oven.

5. The arrangement of claim 2, further comprising an oven provided with a lower wall and a spaced upper wall, each of which is formed by a heater including a cavity in fluid communication with said distribution network and with said return network, wherein food is cooked between the lower and upper walls, and wherein the temperature of the lower and upper walls can be separately regulated via the plurality of valves.

6. The arrangement of claim 2, further comprising an oven which is associated with a second heat exchanger forming part of said circuit, through which said thermal fluid flows and which is provided with a large heat-exchanging surface, there being impeller means adapted to produce a current of air flowing adjacent said heat-exchanging surface and into the interior of said oven.

* * * * *